US006712438B2

(12) United States Patent
Han

(10) Patent No.: US 6,712,438 B2
(45) Date of Patent: Mar. 30, 2004

(54) INK-JET PRINTER AND METHOD OF DRIVING HEAD THEREOF

(75) Inventor: Eun-bong Han, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/241,613

(22) Filed: Sep. 12, 2002

(65) Prior Publication Data

US 2003/0146948 A1 Aug. 7, 2003

(30) Foreign Application Priority Data

Feb. 7, 2002 (KR) ..... 2002-7007

(51) Int. Cl.[7] ..... B41J 29/38; B41J 2/36
(52) U.S. Cl. ..... 347/12; 347/12; 347/190
(58) Field of Search ..... 347/12, 180, 181, 347/182, 190

(56) References Cited

U.S. PATENT DOCUMENTS 5,933,161 A * 8/1999 Sato et al. ..... 347/12

FOREIGN PATENT DOCUMENTS

JP 01069366 A * 3/1989 ..... B41J/3/20

* cited by examiner

*Primary Examiner*—Russell Adams
*Assistant Examiner*—Alfred E. Dudding
(74) *Attorney, Agent, or Firm*—Staas & Halsey LLP

(57) ABSTRACT

An ink-jet printer includes a nozzle driving unit selectively driving a plurality nozzles to discharge ink through the nozzles, a signal supply supplying a driving signal to the nozzle driving unit, a shift register storing a nozzle selection signal to select a nozzle after the nozzle selection signal is synchronized with a clock signal, a counter counting an input number of the clock signal and deciding whether to operate the shift register, and a controller inputting a discharge signal into the signal supply to discharge the ink when the shift register is disabled. The counter compares a set-up value set up in accordance with a bit number of the nozzle selection data signal with the input number of the clock signal to disable the shift register. Therefore, noise introduced into the noise selection signal by the discharge signal is eliminated. Thus a malfunction of the head driving device can be prevented.

45 Claims, 7 Drawing Sheets

CLOCK

P_Data
Data_a
Data_b
Data_c

ADDR
Addr_1
Addr_2
Addr_3

LOAD

STRB
STRB_0
STRB_1
STRB_2

RESET

INK-JET PRINTER AND METHOD OF DRIVING HEAD THEREOF

CROSS-REFERENCE TO RELATED APPLICATIONS

This application claims the benefit of Korean Application No. 2002-7007, filed Feb. 7, 2002, in the Korean Industrial Property Office, the disclosure of which is incorporated herein by reference.

BACKGROUND OF THE INVENTION

1. Field of the Invention

The present invention relates to an ink-jet printer, and more particularly, to an ink-jet printer capable of preventing a malfunction of a head driving unit, which occurs when ink is simultaneously discharged from a plurality of nozzles.

2. Description of the Related Art

Usually, a printer using one of a wire dot method, a heat transfer method, and an ink jet method of forming an image on a recording medium, such as printing paper or an OHP (over head project) film, uses a recording head.

The recording head of an ink-jet printer using one of the above methods has a plurality of nozzles being formed with minute discharging holes to eject ink. The ink in the nozzles is heated and expanded by heating elements disposed in corresponding ones of the nozzles and is ejected outside of the nozzles and stuck on the recording medium.

Accordingly, the ink-jet printer forms the image on the recording medium by ejecting the ink through the nozzles by selectively heating the nozzles in the recording head corresponding to the image to be recorded.

As shown in FIG. 1, a general ink-jet printer 200 includes an interface 210 receiving printing data and a control command from a host 100, an input unit 230 allowing a user to input a selection command, a storage unit 250 storing a program for driving and controlling each part of the ink jet printer 200 and the printing data, a printing unit 270 performing a printing operation, and a controller 290 controlling the entire system of the ink-jet printer 200 in accordance with the program.

A nozzle selection data signal is transmitted to a head driving device 271 of the printing unit 270 in order to drive selected ones of a plurality of nozzles of the recording head 273 in response to the printing data.

As shown in FIG. 2, the head driving device 271 includes a first data unit 21 and a second data unit 23 receiving the nozzle selection data signal having an ADDR (address) data signal ADDR and a P (primitive) data signal P_Data, a signal supply 27 having AND gates, and a nozzle driving unit 29 driving the selected nozzle among the plurality of nozzles to discharge the ink.

For example, in a case of the recording head having an n×m number of nozzles, the ADDR data signal ADDR is a data signal to select one of n number of fire groups A1–An each having an m number of nozzles, and the P data signal P_Data is a data signal to select a predetermined number of nozzles among the m number of nozzles in a corresponding one of the fire groups A1–An.

In other words, when the ADDR data signal ADDR and the P_data signal P_Data have 10 bits, then one fire group is selected among the 10 fire groups A1–A10 in response to corresponding one of the 10-bits of the ADDR data signal ADDR, and the number of the nozzles capable of simultaneously discharging the ink in response to the P data signal P-Data in the fire groups A1–A10 is 10. In other words, the entire number of nozzles of the recording head is 10×10=100.

Hereinbelow, a general operation of the head driving device 271 according to the input data signals will be described by referring to FIGS. 3A–3F.

The ADDR data signal Addr_1 and the P_data signal Data_a of the nozzle selection data signal are synchronized with a clock signal CLOCK, shifted to each bit shift register, and stored in each latch.

Then, when a load signal LOAD is input, the ADDR data signal Addr_1 and the P_data signal Data_a stored in each of the bit shift register are latched.

After that, when a fire strobe signal STRB_1 to discharge the ink in the nozzles by heating the heating element is input from the controller 290 to the signal supply 27, next ADDR data signal Addr_2 and next P data signal Data_b are stored in respective one of the n-bit shift register and the m-bit shift resistor.

Therefore, the latched data signals Addr_1 and Data_a and the strobe signal STRB_1 are input into the signal supply 27 having the n×m number of AND gates to drive the nozzle driving unit 29.

In other words, a transistor (or FET) of the nozzle driving unit 29 is turned on in response to an output signal of the AND gate corresponding to the selected nozzle among the n×m number of AND gates of the signal supply 27.

Therefore, an electric current flows as a driving voltage is supplied to each heating element connected with the turned on transistor (or FET) among the n×m number of transistors (or FET) to eject the ink through the selected nozzle.

As described above, to discharge the ink from the plurality of nozzles, a large amount of electric current is required.

Recently, the number of nozzles simultaneously discharging the ink in order to perform a high density and printing speed has been increased. Accordingly, a high electric current flows to a power supply terminal Vp of the recording head 273 of the printing unit 270.

As shown in FIGS. 4A–4G, the high electric current flowing to the power supply terminal Vp in order to drive the plurality of the nozzles causes a noise signal to be input to an input signal line (P_data, ADDR). Because the high electric current flows to the recording head 273 within a relatively short period of time, the power supply terminal Vp becomes unstable, and as a result, the noise signal is produced.

Therefore, there is a problem of a malfunction in controlling the nozzles as the noise signal is input into the head driving device together with the data signals.

SUMMARY OF THE INVENTION

The present invention has been made to overcome the above and other problems of the related art. Accordingly, it is the object of the present invention to provide an ink-jet printer capable of preventing a malfunction of a head driving device, which is generated when the ink is simultaneously discharged from a plurality of nozzles.

Additional objects and advantages of the invention will be set forth in part in the description which follows and, in part, will be obvious from the description, or may be learned by practice of the invention.

An ink-jet printer is provided in order to achieve the above and other objects and includes a nozzle driving unit driving a plurality of nozzles to discharge ink, a signal supply supplying a driving signal to the nozzle driving unit, a shift register storing the nozzle selection signal to select a nozzle in response to a recording image after the nozzle selection signal is synchronized with a clock signal, a counter counting an input number of the clock signal and deciding whether to operate the shift register, and a controller inputting a discharge signal to discharge the ink into the signal supply when the shift register is disabled.

The counter compares a set-up value set up in accordance with a predetermined bit number of the nozzle selection data signal and the input number of the clock signal. When the input number is over the set-up value, the shift register is disabled.

On the other hand, a method of driving a head of an ink-jet printer according to an aspect of the present invention includes inputting a nozzle selection data signal to select a nozzle among a plurality of nozzles into a shift register when the nozzle selection data signal is synchronized with a clock signal, disabling the shift register when an input number is above a predetermined value after counting the input number of the clock signal, latching the nozzle selection data signal stored in the shift register, and inputting a discharge signal to discharge ink from the selected nozzle based on the latched nozzle selection data signal.

The latching of the nozzle selection data signal includes resetting a counter counting the input number of clock signals . Therefore, noise generated in the data signal by the discharge signal is eliminated as the discharge signal is input after the nozzle selection data signal is stored into the shift register. Thus a malfunction of head driving device can be prevented.

Moreover, even though the noise signal is generated in the data signal, the malfunction of the head driving device caused by the noise signal can be prevented since the data signal as much as the corresponding bit is input into the shift register by the counter.

BRIEF DESCRIPTION OF THE DRAWINGS

These and other objects and advantages of the invention will become apparent and more readily appreciated from the following description of the preferred embodiments taken in conjunction with the accompanying drawings of which.

DETAILED DESCRIPTION OF THE PREFERRED EMBODIMENTS

Figure 1:
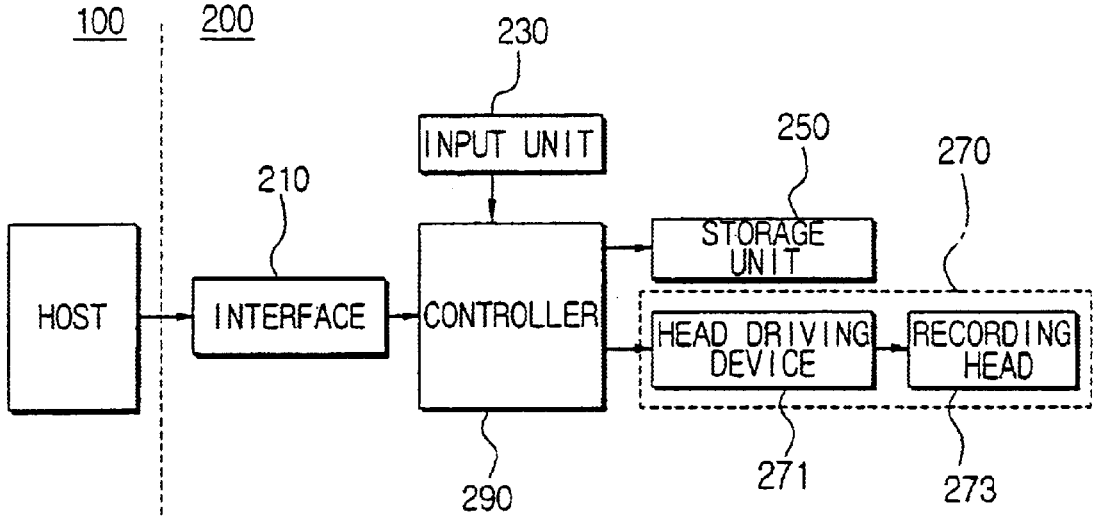
FIG. 1 (PRIOR ART)
FIG. 1 is a block diagram showing a conventional ink-jet printer.
Figure 2:
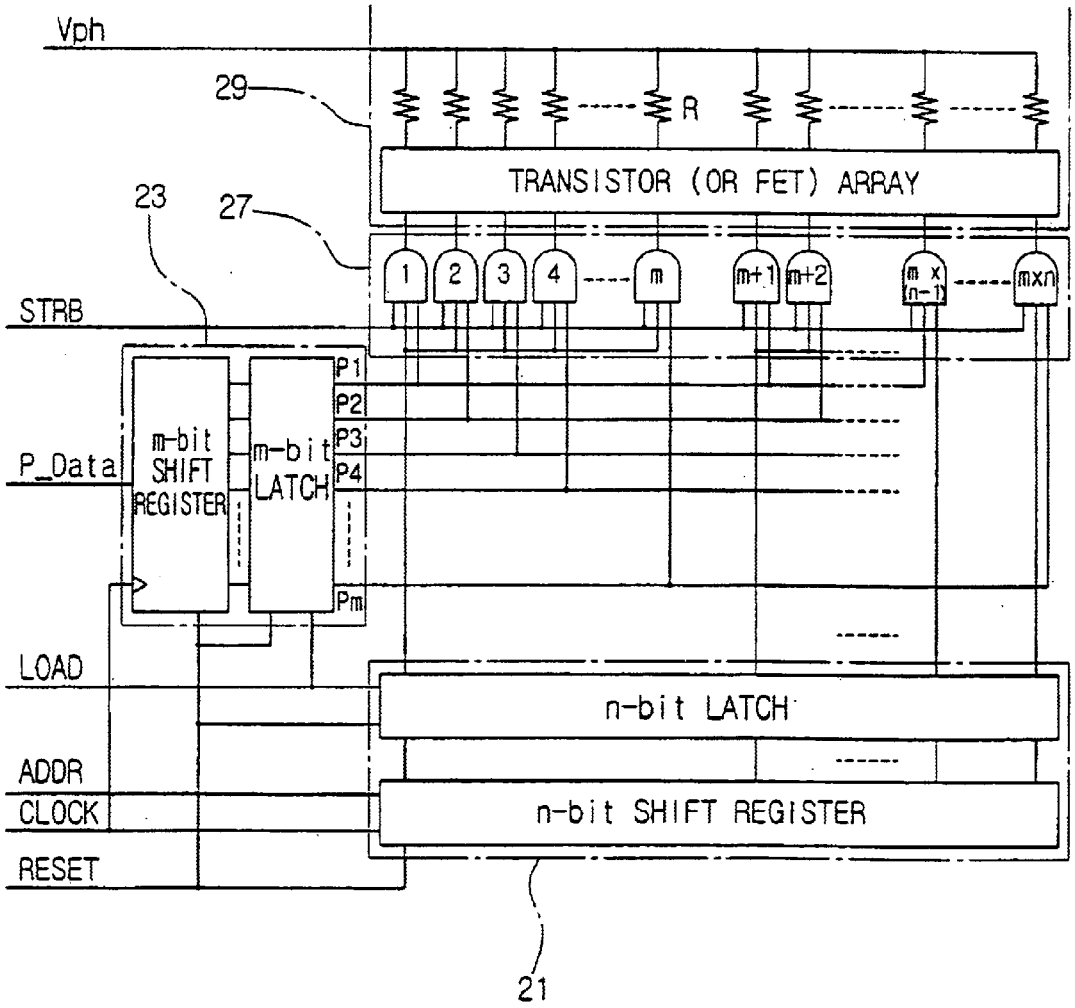
FIG.2 (PRIOR ART)
FIG. 2 is a block diagram showing a head driving device of the ink-jet printer of FIG. 1.
Figures 3A, 3B, 3C, 3D, 3E, 3F:
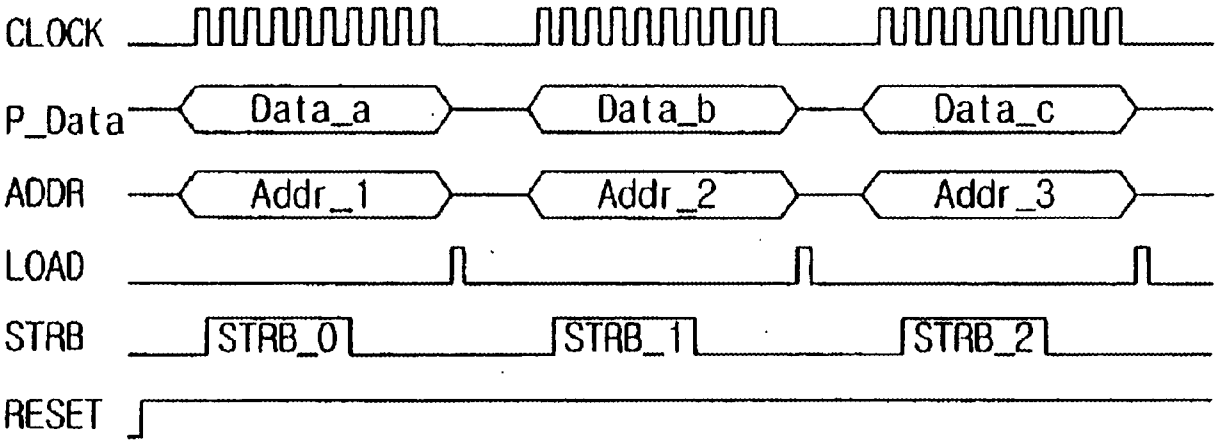
FIG. 3A (PRIOR ART)
FIG. 3B (PRIOR ART)
FIG. 3C (PRIOR ART)
FIG. 3D (PRIOR ART)
FIG. 3E (PRIOR ART)
FIG. 3F (PRIOR ART)
FIGS. 3A–3F are timing charts of input signals of the head driving device of FIG. 2.
Figures 4A, 4B, 4C, 4D, 4E, 4F, 4G:
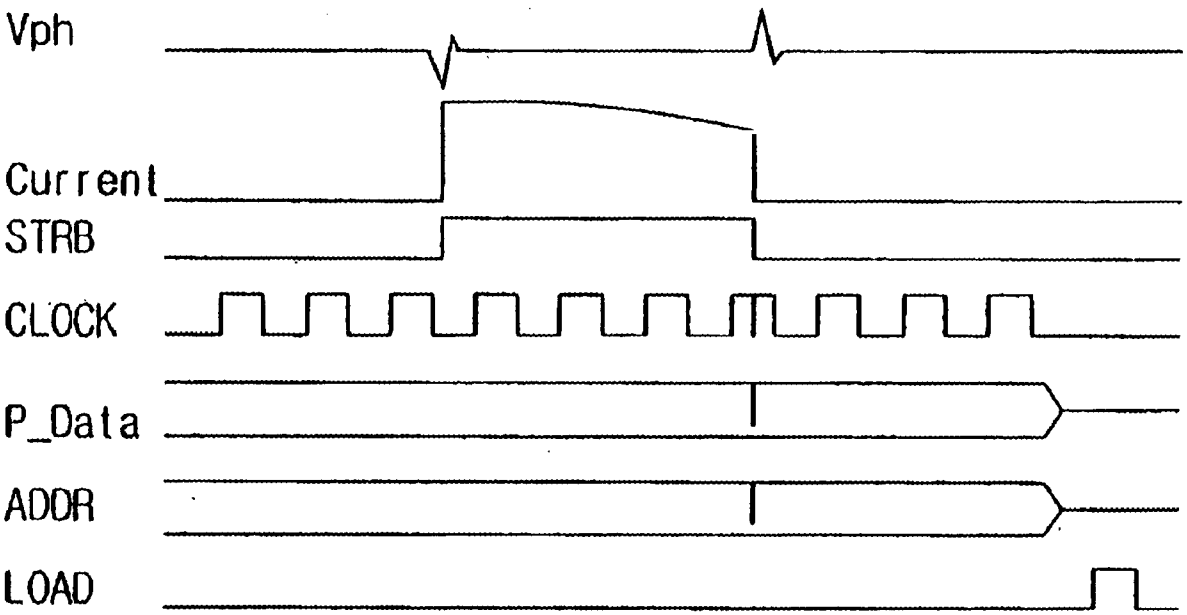
FIG. 4A (PRIOR ART)
FIG. 4B (PRIOR ART)
FIG. 4C (PRIOR ART)
FIG. 4D (PRIOR ART)
FIG. 4E (PRIOR ART)
FIG. 4F (PRIOR ART)
FIG. 4G (PRIOR ART)
FIGS. 4A–4G are views showing a driving voltage Vph wave form and a noise phenomenon generated in the input signals of the head driving device of FIG. 2.

Reference will now be made in detail to the present preferred embodiments of the present invention, examples of which are illustrated in the accompanying drawings, wherein like reference numerals refer to the like elements throughout. The embodiments are described below in order to explain the present invention be referring to the figures.

Herein below, the present invention will be described in greater detail by referring to the appended drawings.

Figure 5:
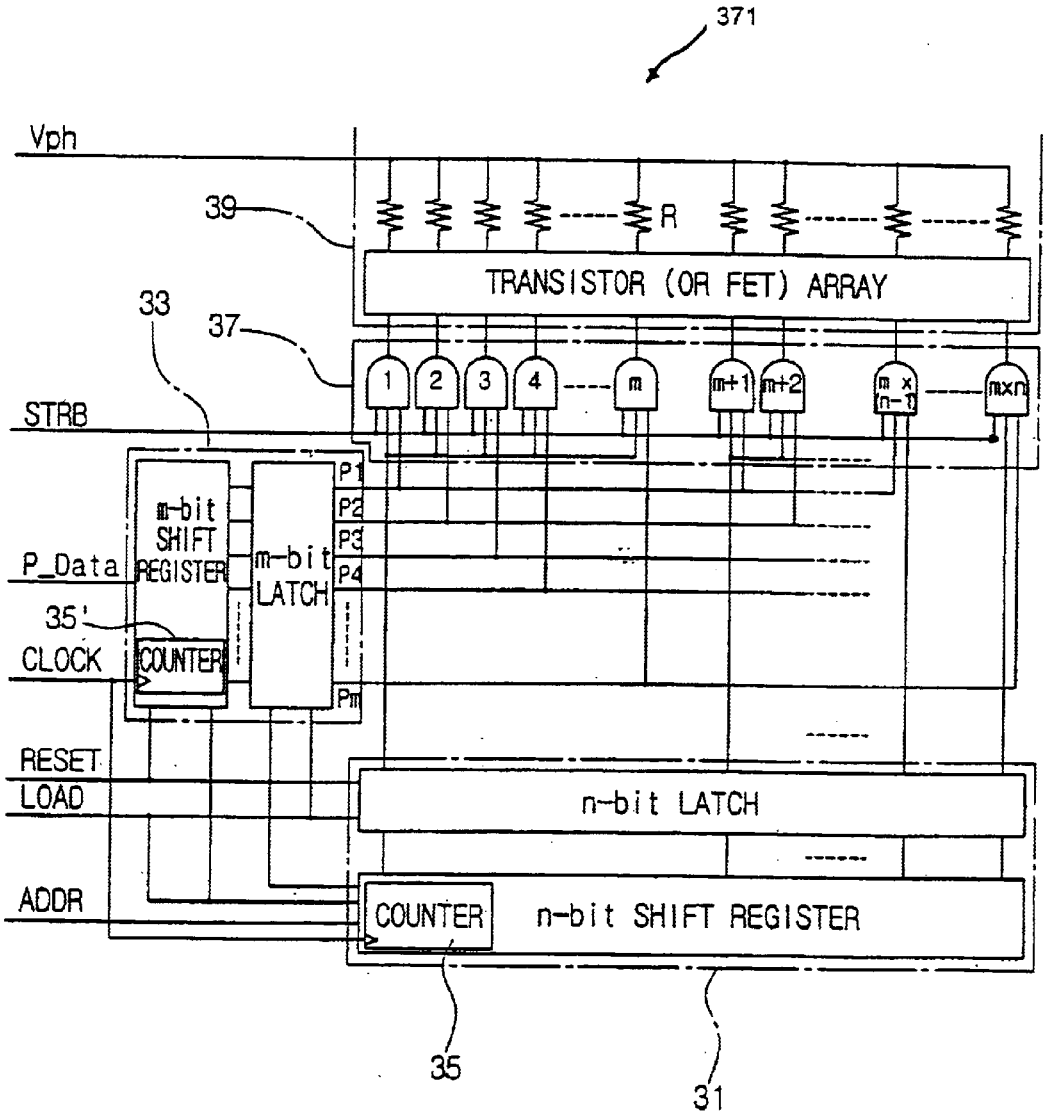
FIG. 5 is a block diagram showing a head driving device of an ink-jet printer according to an embodiment of the present invention.
Figures 6A, 6B, 6C, 6D, 6E, 6F:
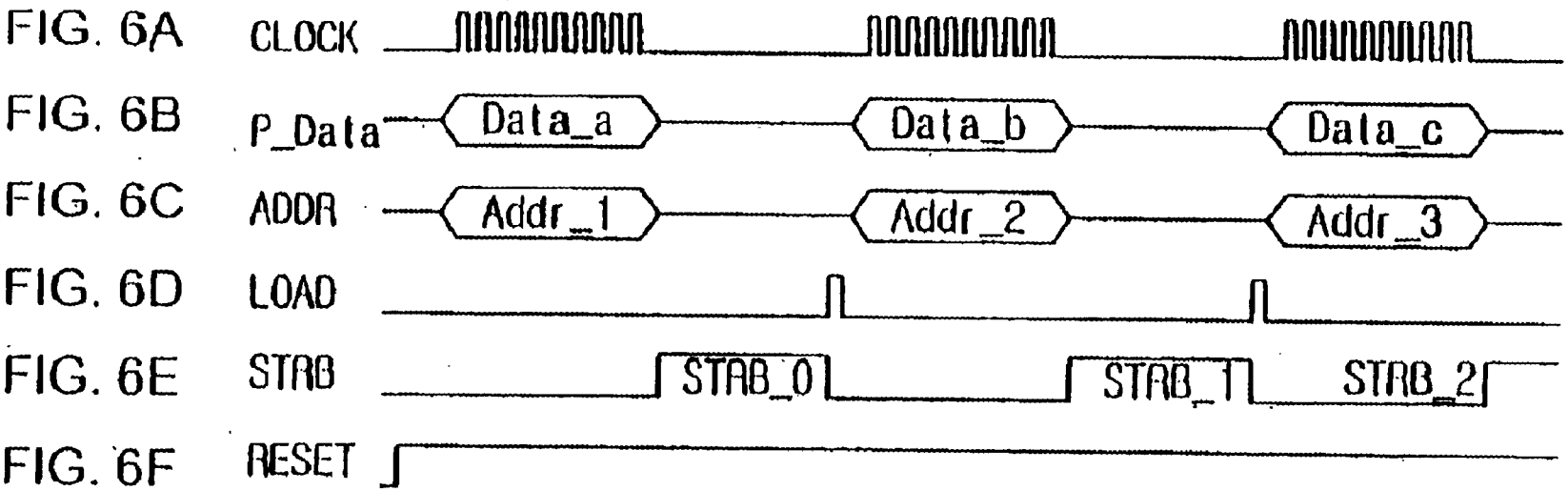
FIGS. 6A–6F are timing charts of input signals of the head driving device of FIG. 5.
Figure 7:
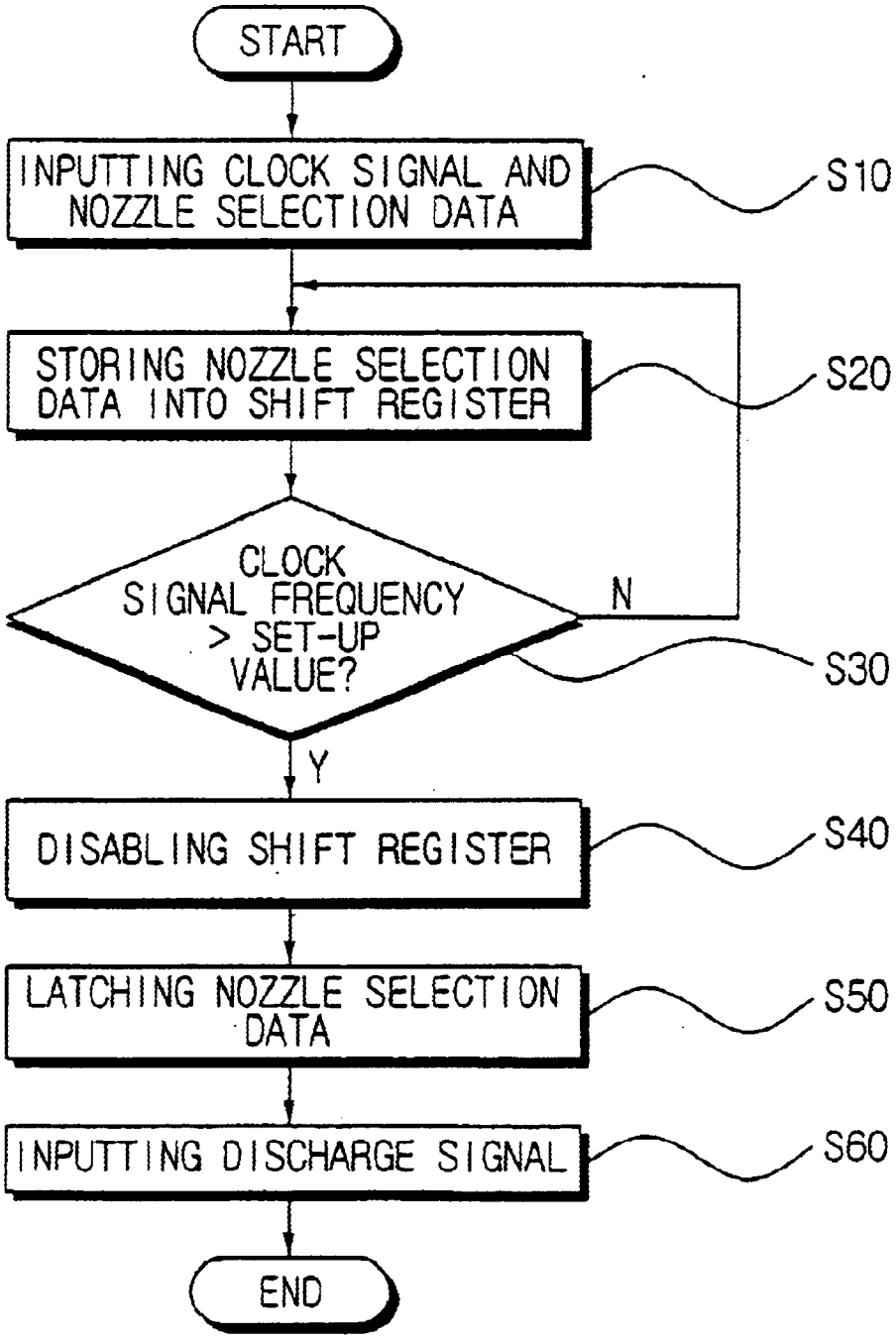
FIG. 7 is a flow chart showing a method of driving the head driving device of FIG. 5.

Referring to FIG. 5, in an ink-jet printer according to an embodiment of the present invention, a head driving device 371 corresponds to the head driving device 271 of FIG. 1 and driving a recording head 273 of FIG. 1 with n×m number of nozzles will be described. Here, n is the number of fire groups, and m is the number of the nozzles in each fire group. Same reference numerals have been given to the same elements as those described in FIGS. 1–4G.

The head driving device 371 includes a first data unit 31 and a second data unit 33 synchronizing an n bit ADDR data signal and an m bit P data signal P_Data, which are nozzle selection data signals to select respective nozzles of the recording head 273 in response to an image to be recorded, with a clock signal CLOCK and temporarily storing the nozzle selection data signals, n-bit and m-bit counters 35, 35' controlling the ADDR data signal and the P data signal P_Data by counting the clock signal CLOCK, a signal supply 37 having AND gates and a nozzle driving unit 39 driving the nozzle selected from the n×m number of nozzles in response to the ADDR data signal and the P data signal P_Data to discharge the ink through the selected nozzle.

The first data unit 31 has an n-bit shift register to shift the n-bit ADDR data signal, such as Addr_1, Addr_2, Addr_3, by synchronizing with the clock signal CLOCK and storing the n-bit ADDR data signal, and an n-bit latch to temporarily latch the n bit ADDR data signal when a load signal LOAD is input.

The first data unit 31 also has the n-bit counter 35. The n-bit counter 35 enables the n bit shift register to store up to the ADDR data signal until an nth clock signal is counted, and disables the n-bit shift register not to store an n+1th ADDR data signal when an n+1th clock signal is counted. On the other hand, when the load signal LOAD is input, the n-bit counter 35 is reset.

The second data unit 33 has an m-bit shift register to store the m-bit P data signal P_Data, such as Data_a, Data_b, and Data_c, after shifting the m bit P data signal P_Data by synchronizing with the clock signal CLOCK, and an m bit latch to temporarily latch the m bit P data signal P_Data when the load signal LOAD is input.

Moreover, the second data unit 33 also has the m-bit counter 35'. The m-bit counter 35' enables the m-bit shift register to store up to an mth P data signal P_Data until an mth clock signal CLOCK is counted, and disables the m-bit shift register not to store an mth P data signal P_Data when an m+1th clock signal CLOCK is counted. On the other hand, when the load signal LOAD is input, the m-bit counter 35 is reset.

Each of the bit counters 35 and 35' can be disposed in the respective n-bit and m-bit shift registers as described above, or separately disposed outside the respective n-bit and m-bit shift registers.

When the data signals ADDR and P_Data are completely input into each of the n-bit and m-bit shift registers and when the n-bit and m-bit shift registers are disabled, a controller 290 inputs a strobe signal STRB, which is a discharge signal to discharge the ink, into the head driving device 271.

The signal supply 37 has a combination of the AND gates (1, 2, . . . m×n ) corresponding to the n×m number of nozzles. When the load signal LOAD is input, the data signals ADDR and P_Data, which are temporarily latched to each latch, are input into corresponding AND gate of the signal supply 37. At this time, an AND gate corresponding to a selected nozzle among the n×m numbers of AND gates outputs an output signal in response to each of the input data signals ADDR and P_Data.

Corresponding one of n×m numbers of transistors (or FET) of the nozzle driving unit 39 is operated by the output signal of the AND gate.

In other words, the electric current is flown to a heating element R of the selected nozzle as a transistor (or FET) corresponding to the selected nozzle among the n×m numbers of the transistors (or FET) is turned on. Therefore, the ink in the selected nozzle is discharged as heat is generated by the heating element R.

A driving method of the head driving device 271 according to the embodiment of the present invention will be described referring to FIGS. 6A–6F and 7.

Firstly, the ADDR data signal Addr_1 and P data signal Data_a of the nozzle selection data signals corresponding to a recording image and the clock signal CLOCK, which is a synchronized signal, are input in operation S10.

The ADDR data signal Addr-1 and the P data signal Data_a are synchronized with the clock signal CLOCK and respectively stored in the n-bit and m-bit shift registers after being shifted in operation S20.

For example, 10 bits of ADDR data signal Addr-1, synchronized with the clock signal CLOCK are input and stored in a corresponding ones of 10 shift registers of 10-bit shift register in operation S20. At this time, 10 bits counter 35 has a set-up value of 10, which is the bit number of the ADDR data signal Addr-1. Accordingly, the 10-bit counter 35 compares a clock signal frequency of the input clock signal CLOCK and the set-up vale in operation S30.

The 10-bit counter 35 allows the input ADDR data signal Addr-1 to be stored into the 10 bit shift register 31 by synchronizing with the clock signal CLOCK until a $10^{th}$ clock signal and the set-up value are counted in operation S20 . After that, 10 bit shift register 31 is disabled so as not to store a certain data signal when an $11^{th}$ clock signal CLOCK is counted in operation S40.

Then, when the load signal LOAD is input, each bit counter 35 and 35' is reset, and at the same time, the ADDR data signal Addr-1 and the n- bit and m-bit shift registers are latched in corresponding n-bit and m-bit latches in operation S50.

When a strobe signal STRB_1 to discharge the ink is input from the controller 290 in operation S60, the strobe signal STRB_1 and each of the latched data signal Addr-1 and Data_a are input to corresponding the input terminals of the AND gate of the signal supply 37.

Here, a strobe signal STRB_0 is a previous discharge signal with respect to a previously selected nozzle of a previously selected fire group of the recording head 273.

An output signal of each AND gate becomes high only when all input signals of input terminals of the AND gate are high due to the characteristic of the AND gate, thus only the AND gate having all high input signals outputs the high output signal.

The transistor (or FET) of the nozzle driving unit 39 corresponding to the high output signal of the AND gate is turned on. Therefore, as a driving voltage Vph is supplied to each transistor (or FET), the electric current is flown to the heating element K of the selected nozzle, and the ink is discharged from the selected nozzle.

In other words, the controller 290 determines whether the ADDR data signal Addr-1 and the P data signal Data_a are completely stored in the n-bit and m-bit shift registers, and then inputs the strobe signal STRB_1. Therefore, the noise presented in the ADDR data signals Addr-1 and the P-data signal Data_a or Addr_2 and Data_b by inputting the strobe signal STRB_1 can be prevented.

Moreover, even though the noise signal is presented in the data signals $ADDR__1$ and Data_a, the noise signal is not input into the shift register by the counters 35 and 35', thus the nozzle driving unit 39 is not affected after that.

Accordingly, the malfunction of the head driving device 271, which is generated when the ink is discharged simultaneously from the plurality of nozzles of the recording head 273, can be prevented.

According to the present invention, the noise flow generated in the data signal by the strobe signal can be eliminated since the strobe signal is input after the nozzle selection data signal is stored into the shift register.

In addition, even though there is a noise signal in the data signal, the malfunction of the head driving device 371 can be prevented by inputting the data signal as much as the amount of the corresponding bit into the shift register by the counter.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An ink-jet printer comprising:

a nozzle driving unit selectively driving a plurality of nozzles to discharge ink;

a signal supply supplying a driving signal to the nozzle driving unit;

a shift register storing a nozzle selection signal to select the nozzles, the nozzle selection signal being synchronized with a clock signal;

a counter counting an input number of the clock signal and determining whether to disable the shift register; and a controller inputting a discharge signal into the signal supply when the shift register is disabled, controlling the shift register to transmit the nozzle selection signal to the signal supply, and controlling the signal supply to generate the driving signal in response to the discharge signal and the nozzle selection signal.

2. The ink-jet printer of claim 1, wherein the counter enables the shift register when the input number of the clock signal is equal to or less than a predetermined set-up value and disables the shift register when the input number is greater than the predetermined set-up value.

3. The ink-jet printer of claim 2, wherein the counter is disposed in the shift register.

4. The ink-jet printer of claim 2, wherein the set-up value is equal to a number of bits contained in the nozzle selection data signal.

5. A method of driving a head of an ink-jet printer, comprising:

inputting a nozzle selection data signal to select a nozzle among a plurality of nozzles into shift registers while synchronizing the nozzle selection data signal with clock signals;

disabling the shift registers when a number of the clock signals is greater than a set-up value after counting the number of the clock signals;

latching the nozzle selection data signal; and inputting a discharge signal to discharge ink from the selected nozzle based on the latched nozzle selection data signal.

6. The method of claim 5, wherein the latching of the nozzle selection data signal comprises resetting the counting when the nozzle selection data is latched.

7. The method of claim 5, wherein the set-up value is equal to a number of bits of the nozzle selection data signal.

8. An ink-jet printer having a plurality of nozzles, comprising:

a controller generating a nozzle selection signal to drive corresponding ones of the nozzles, clock signals, and a strobe signal;

a memory storing the nozzle selection signal;

a counter counting a number of the clock signals and controlling the memory to store the nozzle selection signal in response to the counted number of the clock signals; and a nozzle driving unit driving the nozzles in response to the stored nozzle selection signal and the strobe signal.

9. The ink-jet printer of claim 8, wherein the counter prevents the memory from storing the nozzle selection signal in response to the counted number of the clock signals.

10. The ink-jet printer of claim 8, wherein the counter compares the counted number of the clock signals with a reference value and prevents the memory from storing the nozzle selection signal when the counted number of the clock signals is greater than the reference value.

11. The ink-jet printer of claim 10, wherein the reference value is equal to the number of the nozzles.

12. The ink-jet printer of claim 8, wherein the clock signals and the nozzle selection signal are synchronized with each other.

13. The ink-jet printer of claim 8, wherein the memory comprises shift registers, and a number of the shift registers is equal to a number of the nozzles.

14. The ink-jet printer of claim 13, wherein the counter disables the shift registers to stop storing the nozzle selection signal transmitted from the controller.

15. The ink-jet printer of claim 14, wherein the controller generates the strobe signal after the counter disables the shift registers to prevent noise generated from the strobe signal from being introduced into the shift registers.

16. The ink-jet printer of claim 13, wherein the controller generates a load signal, and the memory comprises a latch temporarily storing the stored nozzle selection signal transmitted from the shift registers in response to the load signal before the stored nozzle selection signal is transmitted to the nozzle driving unit in response to the strobe signal.

17. The ink-jet printer of claim 16, wherein the controller generates the load signal after the counted number of the clock signals is greater than a reference value.

18. The ink-jet printer of claim 16, wherein the counter is reset in response to the load signal transmitted from the controller.

19. The ink-jet printer of claim 18, wherein the controller generates another nozzle selection signal after the load signal is generated, and the reset counter allows the shift registers to store the another nozzle selection signal after the stored nozzle selection signal is latched in the latch in response to the load signal.

20. The ink-jet printer of claim 19, wherein the controller generates the strobe signal after another nozzle selection signal is stored in the shift register, and after the nozzle selection signal is latched in the latch.

21. The ink-jet printer of claim 14, wherein the controller generates the strobe signal after the counter disables the shift registers to stop storing the nozzle selection signal transmitted from the controller.

22. An ink-jet printer having a plurality of first groups of nozzles and a second group of nozzles contained in one of the first groups of nozzles, comprising:

a controller generating a first nozzle selection signal corresponding to the first group of nozzles, a second nozzle selection signal corresponding to the second group of nozzles, clock signals, and a strobe signal;

a first memory storing the first nozzle selection signal;

a second memory storing the second nozzle selection signal;

a first counter counting the clock signals and controlling the first memory to store the first nozzle selection signal in response to a first counted number of the clock signals;

a second counter counting the clock signals and controlling the second memory to store the second nozzle selection signal in response to a second counted number of the clock signals; and a nozzle driving unit driving the nozzles in response to the stored first nozzle selection signal, the stored second nozzle selection signal, and the strobe signal.

23. The ink-jet printer of claim 22, wherein the first and second counters prevent the memory from storing the first and second nozzle selection signals in response to the first and second counted numbers of the clock signals, respectively.

24. The ink-jet printer of claim 22, wherein the first counter compares the first counted number of the clock signals with a first reference value and prevents the first memory from storing the first nozzle selection signal when the first counted number of the clock signals is greater than the first reference value, and the second counter compares the second counted number of the clock signals with a second reference value and prevents the second memory from storing the second nozzle selection signal when the second counted number of the clock signals is greater than the second reference value.

25. The ink-jet printer of claim 24, wherein the first reference value is the same as a number of the first groups, and the second reference value is the same as the number of the nozzles in the second group.

26. The ink-jet printer of claim 22, wherein the first counter disables the first memory to prevent the first memory from storing the first nozzle selection signal transmitted from the controller, and the second counter disables the second memory to prevent the second memory from storing the second nozzle selection signal transmitted from the controller.

27. The ink-jet printer of claim 22, wherein the clock signal, the first nozzle selection signal, and the second nozzle selection signal are synchronized with each other.

28. The ink-jet printer of claim 22, wherein the first memory and the second memory comprise first shift registers and second shift registers, respectively, and a number of the first shift registers is the same as a number of the first groups of nozzles and a number of the second shift registers is the same as a number of the nozzles in the second group of the nozzles.

29. The ink-jet printer of claim 28, wherein the first counter and the second counter disable the first and second shift registers from storing the first and second nozzle selection signals, respectively, to prevent noise generated from the strobe signal from being introduced into the shift registers.

30. The ink-jet printer of claim 28, wherein the first nozzle selection signal comprises a number of first signal bits, and the first counter controls the first shift registers not to store the first signal bits of the first nozzle selection signal when the first counted number of the clock signals is more than the number of the shift registers.

31. The ink-jet printer of claim 30, wherein the second nozzle selection signal comprises a number of second signal bits, and the second counter controls the second shift registers not to store the of the second signal bits of the second nozzle selection signal when the second counted number of the clock signals is more than the number of the second shift registers.

32. The ink-jet printer of claim 22, wherein the controller generates a load signal, and the first and second memories comprise a first latch and a second latch to temporarily store the first and second nozzle selection signals in response to the load signal, respectively.

33. The ink-jet printer of claim 32, wherein the controller generates the strobe signal after the first nozzle selection signal and the second nozzle selection signal are completely stored in the first and second latches, respectively.

34. The ink-jet printer of claim 33, wherein the controller generates the load signal after the first counter and the second counter prevent the first memory and the second memory from storing the first and second nozzle selection signals, respectively.

35. The ink-jet printer of claim 33, wherein the controller generates the strobe signal after the first counter and the second counter prevent the first memory and the second memory from storing the first and second nozzle selection signals, respectively.

36. The ink-jet printer of claim 32, wherein the controller generates another first nozzle selection signal and another second nozzle selection signal after the load signal is generated, and the first and second counters are reset to allow the first and second shift registers to store other first and second selection signals after the stored first and second nozzle selection signals are latched in the first and second latches in response to the load signal, respectively.

37. The ink-jet printer of claim 36, wherein the controller generates the strobe signal after the other first and second nozzle selection signals are stored in the first and second shift registers, respectively, and after the first and second nozzle selection signals are latched in the first and second latches.

38. The ink-jet printer of claim 22, wherein the controller generates the strobe signal after the first nozzle selection signal and the second nozzle selection signal are completely stored in the first and second memories, respectively.

39. The ink-jet printer of claim 22, wherein the first counter and the second counter are reset in response to the load signal transmitted from the controller.

40. An ink-jet printer having a plurality of nozzles, comprising:

a first memory storing a first nozzle selection signal;

a second memory storing a second nozzle selection signal transmitted from the first memory;

a controller generating a strobe signal after the first nozzle selection signal is stored in the first memory to prevent a noise generated due to the strobe signal from being presented in one of the first nozzle selection signal and the second nozzle selection signal; and a nozzle driving unit driving the nozzles in response to the second nozzle selection signal and the strobe signal.

41. The ink-jet printer of claim 40, wherein the first memory comprises a plurality of shift registers, and the second memory comprises a plurality of latches.

42. The ink-jet printer of claim 40, wherein the controller generates the strobe signal after the second nozzle selection signal is stored in the second memory.

43. The ink-jet printer of claim 40, wherein the controller generates clock signals, and the first memory comprises a counter counting a number of clock signals, the controller generating the strobe signal when the counted number of the clock signals is a predetermined reference value.

44. An ink-jet printer having a plurality of nozzles, comprising:

a plurality of shift registers storing a nozzle selection signal;

a controller generating clock signals and a strobe signal;

a nozzle driving unit driving the nozzles in response to the nozzle selection signal and the strobe signal; and a counter counting a number of the clock signals and allowing a same number of bits of the nozzle selection signal as a number of shift registers to be input into the shift registers in response to the counted number of the clock signals to prevent a malfunction of the nozzle driving unit caused by a noise generated by the strobe signal.

45. The ink-jet printer of claim 44, wherein the counter disables the shift registers when the counted number of the clock signals is greater than the number of the shift registers.

* * * * *